US011350804B2

(12) United States Patent
Lv

(10) Patent No.: US 11,350,804 B2
(45) Date of Patent: Jun. 7, 2022

(54) DUSTER CLOTH FOR CLEANING ROBOT AND CLEANING ROBOT USING SAME

(71) Applicant: Ecovacs Robotics Co., Ltd., Suzhou (CN)

(72) Inventor: Xiaoming Lv, Suzhou (CN)

(73) Assignee: ECOVACS ROBOTICS CO., LTD., Suzhou (CN)

( * ) Notice: Subject to any disclaimer, the term of this patent is extended or adjusted under 35 U.S.C. 154(b) by 429 days.

(21) Appl. No.: 15/510,435

(22) PCT Filed: Sep. 15, 2015

(86) PCT No.: PCT/CN2015/089620
§ 371 (c)(1),
(2) Date: Mar. 23, 2017

(87) PCT Pub. No.: WO2016/041487
PCT Pub. Date: Mar. 24, 2016

(65) Prior Publication Data

US 2017/0265695 A1 Sep. 21, 2017

(30) Foreign Application Priority Data

Sep. 15, 2014 (CN) ..... 201420528539.X

(51) Int. Cl.
*A47L 1/02* (2006.01)
*A47L 13/16* (2006.01)

(52) U.S. Cl.
CPC ..... *A47L 1/02* (2013.01); *A47L 13/16* (2013.01)

(58) Field of Classification Search
CPC .. A47L 13/17; A47L 2201/00; A47L 2201/04; A47L 2201/06
See application file for complete search history.

(56) References Cited

U.S. PATENT DOCUMENTS 1,877,527 A * 9/1932 Moran ..... B29C 44/10 15/244.4
2,290,216 A * 7/1942 Steinmetz ..... A47L 17/00 15/244.1

(Continued)

FOREIGN PATENT DOCUMENTS

CN 101371767 A 2/2009
CN 201481323 U 5/2010

(Continued)

OTHER PUBLICATIONS

"Foam rubber." Aug. 30, 2018. Wikipedia. <https://en.wikipedia.org/wiki/Foam_rubber>. (Year: 2018).*

(Continued)

*Primary Examiner* — Joel D Crandall
(74) *Attorney, Agent, or Firm* — Maschoff Brennan

(57) ABSTRACT

The present invention relates to a duster cloth for a cleaning robot and a cleaning robot using the duster cloth. The duster cloth comprises a detachable connection part (21) close to a base of the robot, a wiping cloth (22) close to a surface to be cleaned, and an elastic sealing layer located between the detachable connection part (21) and the wiping cloth (22). The elastic sealing layer is attached to both the detachable connection part (21) and the wiping cloth (22). The elastic sealing layer is made from a foamed EPDM material (23), an integral skin sponge (33) or a common sponge (43), wherein a sealing film (24) is arranged on at least one side of the common sponge (43). The detachable connection part (21) may be a Velcro. With the structure of the elastic sealing layer between the detachable connection part and the wiping cloth, the duster cloth has good elasticity, and the air-tightness of the negative pressure chamber of the cleaning robot is greatly improved.

6 Claims, 3 Drawing Sheets

(56) References Cited

U.S. PATENT DOCUMENTS

| | | | | |
|---|---|---|---|---|
| 3,083,392 | A * | 4/1963 | Sewell | A47K 7/02 15/118 |
| 3,857,133 | A * | 12/1974 | Linenfelser | A47L 13/16 15/118 |
| 6,685,376 | B2 * | 2/2004 | Weihrauch | A47L 13/16 15/244.1 |
| 7,320,149 | B1 * | 1/2008 | Huffman | A47L 11/24 15/319 |
| 2004/0031113 | A1 * | 2/2004 | Wosewick | A47L 11/10 15/98 |
| 2005/0060829 | A1 | 3/2005 | Silvers | |
| 2009/0276971 | A1 * | 11/2009 | Nozari | B32B 5/245 15/118 |
| 2010/0147329 | A1 * | 6/2010 | Leymonerie | A47L 13/16 134/6 |
| 2013/0037050 | A1 | 2/2013 | Chao | |

FOREIGN PATENT DOCUMENTS

| | | | |
|---|---|---|---|
| CN | 103356118 | A | 10/2013 |
| CN | 103622634 | A | 3/2014 |
| CN | 203539223 | U | 4/2014 |
| CN | 203802381 | U | 9/2014 |
| CN | 204071980 | U | 1/2015 |
| DE | 102012111149 | A1 | 5/2014 |
| EP | 1 113 099 | A2 | 7/2001 |
| JP | H 05-84160 | A | 4/1993 |
| JP | 07-000938 | A | 1/1995 |
| JP | 2002-000530 | A | 1/2002 |
| JP | 2003173671 | A | 6/2003 |
| JP | 2006-112526 | A | 4/2006 |
| JP | 3178286 | U | 9/2012 |
| KR | 10 2006 0059 921 | A | 10/2006 |
| TW | 096 136 972 | | 4/2009 |
| TW | 100 218 972 | | 3/2012 |
| TW | 100 218 973 | | 3/2012 |
| TW | 102 211 312 | | 1/2014 |

OTHER PUBLICATIONS

Extended European Search Report in European Patent Application No. 15841352 dated May 14, 2018, 5 pages.

* cited by examiner

DUSTER CLOTH FOR CLEANING ROBOT AND CLEANING ROBOT USING SAME

CROSS-REFERENCE TO RELATED APPLICATIONS

This application is a U.S. national stage of PCT/CN2015/089620, filed on Sep. 15, 2015, which claims priority to Chinese Patent Application No. 201420528539.X, filed on Sep. 15, 2014, the contents of which are each incorporated herein by reference in its entirety.

FIELD OF THE INVENTION

The present invention relates to a duster cloth for a cleaning robot and a cleaning robot using the same, which belongs to the technical field of small household electric appliances.

BACKGROUND ART

In the modern life, the cleaning robot has gradually become indispensable. One of the technical essentials is how to adsorb the robot onto a plane, such as glass, with lower power. Chinese patent with the application number of 201420119672.X discloses a glass-wiping adsorption robot, at the bottom of the body of which there is provided a negative pressure chamber 400 which is formed to be surrounded by the body, a duster cloth 2 and the glass as shown in FIG. 1. The negative pressure chamber 400 is vacuumized via a fan 4 so as to adsorb the machine onto the surface of the glass. If the duster cloth 2, which acts as a constituent part of the negative pressure chamber 400, does not possess excellent air-tightness, it is likely to cause leakage in the negative pressure chamber 400, resulting in that the machine is not adsorbed firmly. The duster cloth 2 employed by such machine is a common sponge. Although such sponge has a good compression property, the air permeability is too good such that it may cause negative pressure leakage easily, which is not good for the adsorption of the robot.

SUMMARY OF THE INVENTION

The object of the present invention is to provide a duster cloth for a cleaning robot for overcoming the deficiencies in the prior art. The duster cloth possesses better elasticity and air-tightness, and can change the air permeability of the ordinary duster cloth effectively so as to overcome the problem of easy negative pressure leakage.

The object of the present invention is realized through the following technical solutions:

The present invention provides a duster cloth for a cleaning robot. The duster cloth comprises a layer of wiping cloth in contact with a surface to be cleaned. The duster cloth further comprises a detachable connection part close to a base of the robot and an elastic sealing layer located between the wiping cloth and the detachable connection part.

Preferably, said elastic sealing layer is made of a foamed EPDM material.

Preferably, said elastic sealing layer is made of an integral skin sponge.

Preferably, said elastic sealing layer comprises a common sponge and one layer of sealing film provided on at least one of the upper side and the lower side of the common sponge.

Preferably, said detachable connection part is a Velcro.

The present invention further provides a cleaning robot comprising a walking unit, a vacuumizing unit and a negative pressure space, wherein the vacuumizing unit comprises a fan motor and fan blades; and the negative pressure space is formed to be surrounded by a base of the robot, a surface to be cleaned and a duster cloth, and said duster cloth comprises a layer of wiping cloth in contact with the surface to be cleaned and further comprises a detachable connection part close to the base of the robot and an elastic sealing layer located between the wiping cloth and the detachable connection part.

Said elastic sealing layer is made of a foamed EPDM material, an integral skin sponge, or a common sponge being provided with one layer of sealing film on at least one of the upper surface and the lower surface thereof.

In the present invention, with the structure of the elastic sealing layer between the Velcro and the wiping cloth, the duster cloth has good elasticity, and the air-tightness of the negative pressure chamber of the cleaning robot is greatly improved.

The technical solution of the present invention now will be described in detail with reference to the accompanying drawings and specific embodiments.

DESCRIPTION OF ATTACHED DRAWINGS

DETAILED DESCRIPTION OF PREFERRED EMBODIMENTS

The duster cloth of the present invention is further described with reference to FIGS. 2-5.

Figure 1:
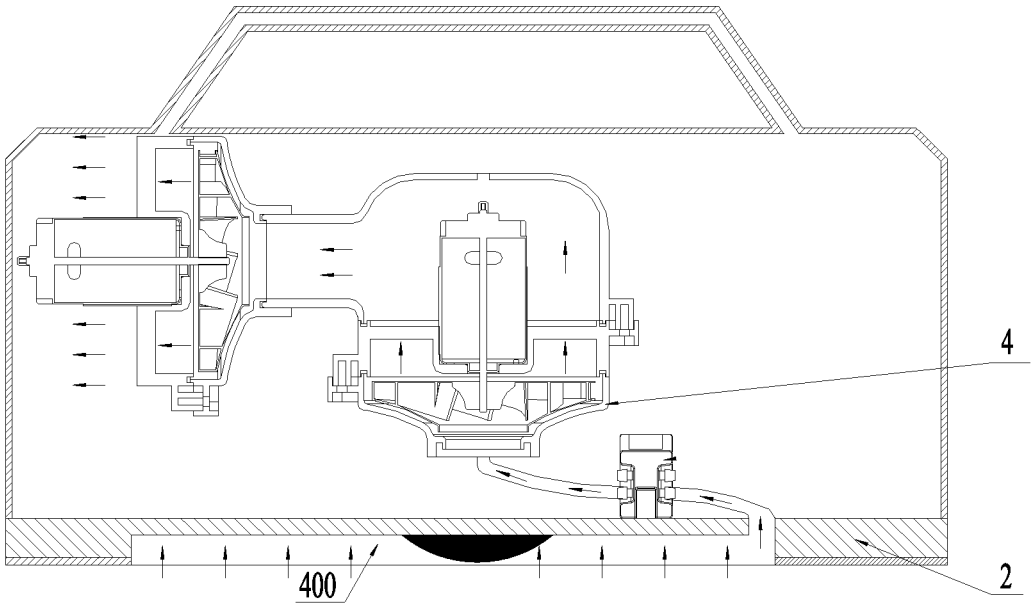
FIG. 1 is a schematic diagram of the structure of the adsorption robot according to the prior art.
Figure 2:
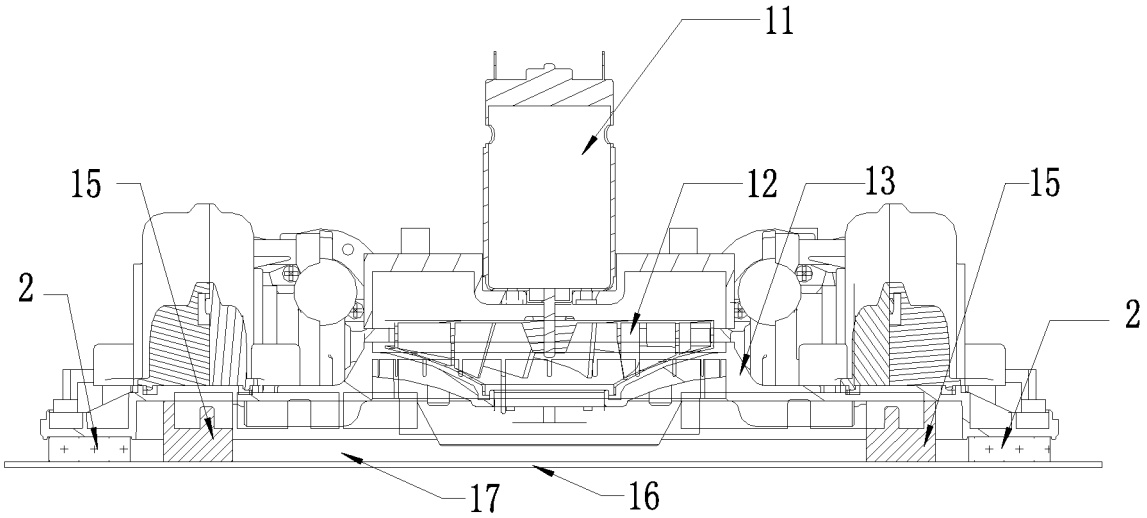
FIG. 2 is a schematic diagram of the structure of the cleaning robot according to the present invention.

FIG. 2 is a partially sectioned schematic diagram of the cleaning robot in working according to the present invention. As shown in FIG. 2, the cleaning robot comprises a walking unit, a vacuumizing unit and a negative pressure space 17. In the present embodiment, the walking unit is a driving belt 15. The vacuumizing unit comprises a fan motor 11 and fan blades 12. The negative pressure space 17 is formed to be surrounded by a base 13 of the robot, a surface 16 to be cleaned and a duster cloth 2. When the fan motor 11 drives the fan blades 12 to rotate so as to draw off the air from the negative pressure space 17, the pressure P, which is lower than the outside atmospheric pressure, is quickly formed inside the negative pressure space 17, and thus the robot is adsorbed onto the surface 16 to be cleaned under such pressure difference.

During this process, actually the air may continuously enter the negative pressure space 17 through the duster cloth 2. If the air-tightness of the duster cloth 2 is not good enough, the pressure P will not reach a relatively small value. In view of this, the present invention provides a duster cloth with excellent air-tightness, and the duster cloth comprises a detachable connection part close to the base 13 of the robot, a wiping cloth in contact with the surface to be cleaned, and an elastic sealing layer located between the detachable connection part and the wiping cloth. The elastic sealing layer is made of a foamed EPDM material, an integral skin sponge, or a common sponge being provided with one layer of sealing film on at least one of the upper side and the lower side thereof. Further, the detachable connection part may be a hooked-loop connection member made of a polymer, for example, normally known as a Velcro or a buckle. The Velcro is detachably affixed to the base 13 of the machine so as to be replaced for cleaning at an appropriate time. The wiping cloth is used to clean the working surface. The elastic sealing layer functions to better attach the machine to the surface to be cleaned when the machine is pressed on the surface to be cleaned by the atmospheric pressure. Hereinafter, the three embodiments of the present invention will be described with reference to FIGS. 3-5.

First Embodiment

Figure 3:
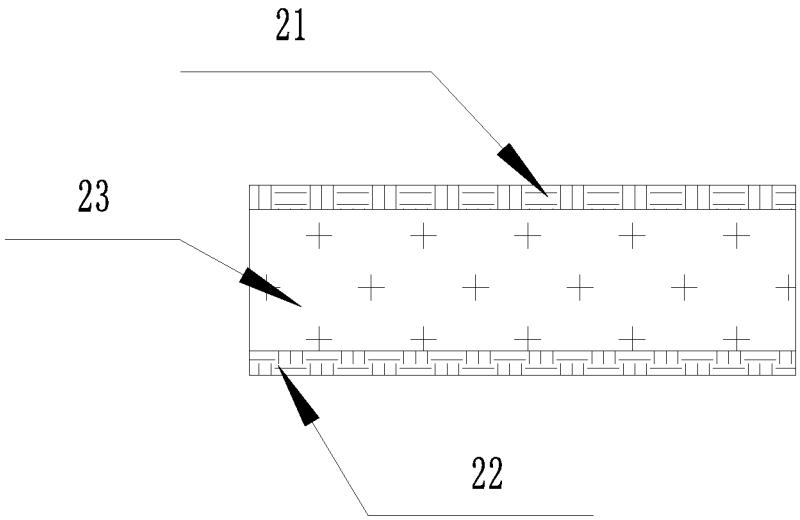
FIG. 3 is a schematic diagram of the structure of the duster cloth made of a foamed EPDM material according to the first embodiment of the present invention.

FIG. 3 is a schematic diagram of the structure of the first embodiment of the present invention. As shown in FIG. 3, the duster cloth in the present invention consists of three layers, in which the top layer (i.e. the layer close to the base 13) is the Velcro 21, the bottom layer is the wiping cloth 22, and the elastic sealing layer is made of the foamed EPDM (ethylene propylene diene monomer) material 23 and the two surfaces of the elastic sealing layer are attached to the Velcro 21 and the wiping cloth 22, respectively. Due to the property of the EPDM material, it is possible to effectively improve the air-tightness of the space 17 while the elastic property of the EPDM material is ensured.

Second Embodiment

Figure 4:
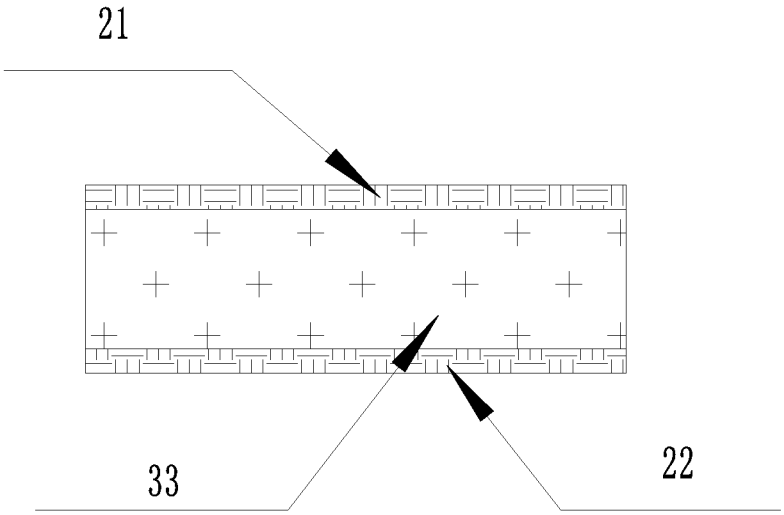
FIG. 4 is a schematic diagram of the structure of the duster cloth made of an integral skin sponge according to the second embodiment of the present invention.

FIG. 4 is a schematic diagram of the structure of the second embodiment of the present invention. As shown in FIG. 4, the present embodiment is different from the first embodiment in that the elastic sealing layer is replaced with an integral skin sponge 33. The integral skin sponge is different from the general sponge, in which the skin and the core of the integral skin sponge are formed at one time during foam molding owing to the foaming composition. Since the integral skin on the surface of the integral skin sponge blocks a part of the channels through which the outside air flows up-and-down when it enters the space 17, the air-tightness of the space 17 is improved.

Third Embodiment

Figure 5:
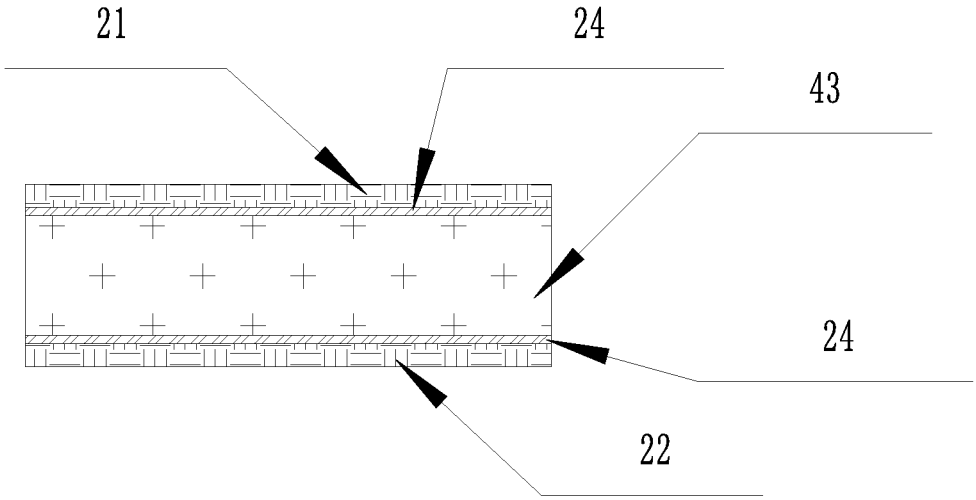
FIG. 5 is a schematic diagram of the structure of the duster cloth made of a sponge according to the third embodiment of the present invention.

FIG. 5 is a schematic diagram of the structure of the third embodiment of the present invention. As shown in FIG. 5, the present embodiment is different from the first and second embodiments in that the elastic sealing layer comprises a common sponge 43 and one layer of sealing film 24 provided on at least one of the upper side and the lower side of the common sponge. Preferably, the sealing film is provided on the whole periphery of the common sponge. When the common sponge is relatively thinner, for example, 2-3 mm, it is only necessary to seal at least one of the upper side and the lower side. In the present embodiment, each of the two sides of the common sponge 43 is provided with one layer of the sealing film 24, that is, there is provided one layer of the sealing film 24 between the common sponge 43 and the Velcro 21 of the top layer, and there is also provided one layer of the sealing film 24 between the common sponge 43 and the wiping cloth 22 of the bottom layer. The sealing film may be a plastic film. Since the existence of the film blocks a part of the channels through which the outside air flows up-and-down when it enters the space 17, it can also achieve the purpose of improving the air-tightness.

Of course, said sealing film 24 may be applied to at least one side of the elastic sealing layer of the first and second embodiments as well, which is likely to achieve better air-tightness.

In conclusion, in the present invention, with the structure of the elastic sealing layer, which is made of the foamed EPDM material, the integral skin sponge, or the common sponge being provided with one layer of sealing film on at least one side thereof, between the Velcro and the wiping cloth, the duster cloth has good elasticity, and the air-tightness of the negative pressure chamber of the cleaning robot is greatly improved.

What is claimed is:

1. A cleaning robot comprising a walking unit, a vacuumizing unit and a negative pressure space, wherein the vacuumizing unit comprises a fan motor and fan blades; and the negative pressure space is formed to be surrounded by a base of the robot, a surface to be cleaned and a duster cloth, the duster cloth comprising a layer of wiping cloth in contact with a surface to be cleaned, the duster cloth further comprising a detachable connection part close to and detachable from a base of the robot and a sealing layer located between the wiping cloth and the detachable connection part and wherein the sealing layer is elastic; wherein the sealing layer further comprises a sealing film, and the sealing film is provided on at least one of an upper side and an lower side of the sealing layer; and wherein the duster cloth surrounds a sealing chamber.

2. The cleaning robot of claim 1, wherein the sealing layer is made of a foamed EPDM material.

3. The cleaning robot of claim 1, wherein the sealing layer is made of a sponge made by an integral skin foaming processing, and wherein the sponge made by the integral skin foaming processing has a skin with a first density and a core with a second density, and the first density is larger than the second density.

4. The cleaning robot of claim 1, wherein the sealing layer comprises a sponge and one layer of sealing film provided on at least one of the upper side and the lower side of the sponge.

5. The cleaning robot of claim 4, wherein the thickness of the sponge is larger than 2 mm and less than 3 mm.

6. The cleaning robot of claim 1, wherein said detachable connection part is a hooked-loop connection member.

* * * * *